US005363759A

United States Patent [19]

D'Ambrosio

[11] Patent Number: 5,363,759

[45] Date of Patent: Nov. 15, 1994

[54] HAND-OPERATED CAN PRESS

[76] Inventor: George A. D'Ambrosio, Peapond Rd., Katonah, N.Y. 10536

[21] Appl. No.: 133,906

[22] Filed: Oct. 12, 1993

[51] Int. Cl.[5] ..... B30B 9/06; B30B 15/06

[52] U.S. Cl. ..... 100/110; 99/495; 100/265; 100/295

[58] Field of Search ..... 100/110, 116, 245, 247, 100/248, 265, 295, 910, 229 R, 229 A; 99/495

[56] References Cited

U.S. PATENT DOCUMENTS

| | | | |
|---|---|---|---|
| 207,974 | 9/1878 | McConnell . | |
| 1,422,196 | 7/1922 | Gray | 100/229 R X |
| 1,767,054 | 6/1930 | Briggs | 100/910 X |
| 1,835,966 | 12/1931 | Pochyla | 100/295 X |
| 1,990,894 | 2/1935 | Brubaker | 100/265 X |
| 2,664,042 | 12/1953 | Walker . | |
| 2,678,000 | 5/1954 | Scheidt et al. | 100/295 X |
| 3,120,678 | 2/1964 | Glenny | 100/910 X |
| 3,464,344 | 9/1969 | Hawthorne | 100/295 X |
| 3,515,057 | 6/1970 | Aldridge | 100/295 X |
| 3,995,544 | 12/1976 | Farley | 100/116 |
| 4,334,469 | 6/1982 | Tanner et al. | 100/295 X |
| 4,355,574 | 10/1982 | Bond et al. | 100/234 |
| 4,860,647 | 8/1989 | Kerslake | 100/234 |
| 5,001,911 | 3/1991 | Eck et al. | 100/116 X |
| 5,272,968 | 12/1993 | Keville et al. | 100/110 |

*Primary Examiner*—Stephen F. Gerrity
*Attorney, Agent, or Firm*—Charles J. Brown

[57] ABSTRACT

A hand press for squeezing liquid from contents of a can wherein the can is positionable on a base and with one hand a pair of handles are grasped and squeezed together to push a platen against a severed can end and squeeze out the liquid while the can is held by that one grasping hand over an appropriate drainage receiver such as a sink.

10 Claims, 1 Drawing Sheet

HAND-OPERATED CAN PRESS

BACKGROUND OF THE INVENTION

It is a common culinary practice to press liquid from certain can contents, such as tuna or the like, by manually forcing one severed can lid into the can to squeeze the liquid out of the contents while holding the can over a sink or bowl. This can be a time consuming and messy procedure with liquid tending to squirt out unpredictably. It may also be injurious if care is not taken to guard against finger cuts on the sharp severed can end edges, essentially while removing the can end after pressing is completed.

Following the design of long-known masher utensils such as that of U.S. Pat. No. 207,974, various scissors-type can presses have been proposed. One example is disclosed in U.S. Pat. No. 4,860,647 which has the disadvantage of a plunger stroke curving into the can, only partially offset by an angled plunger face, with the result that the plunger face is not forced straight into the can. Another scissor-type design is shown in U.S. Pat. No. 4,355,574 which is merely a modified pair of kitchen tongs from which the can may slip accidentally during operation and which cannot assert very great squeezing forces without hurting the fingers of the operator.

Straight-stroke ram-type can presses have also been proposed. One overly simple form is the press of U.S. Pat. No. 3,995,544 which requires both hands to operate if it is to be held over a sink or bowl to receive the drained liquid. In other fields unrelated to can presses, ram-type presses are known in which platens slide along parallel standards during operation, but they are complicated devices involving hydraulic systems or complex gear trains. Those disclosed in U.S. Pat. Nos. 2,664,042 and 5,001,911 are examples.

The principal object of the present invention is to provide a simple hand press for cans of tuna or the like which may be operated with one hand alone while the press and can are extended by that one hand over a sink or bowl and in which the severed can lid is forced straight into the can for squeezing the contents and forcing out the liquid.

SUMMARY OF THE INVENTION

A hand-operated can press is provided by the invention for forcing a can end axially into moist can contents against an opposite unsevered can end to expel liquid from the contents. The press of the invention comprises a base on which the unsevered can end is positionable. At least one elongated standard extends rigidly and substantially perpendicularly from the base to be alongside the positioned can and parallel to the can axis. A slide element is linearly translatable along the standard. A platen is mounted on the slide element for linear movement from a retracted position permitting placement of the can on the base to an inserted position engaging and pressing the severed can end into the moist contents within the can. Substantially parallel opposed inner and outer squeezing handles extend substantially perpendicularly from the standard and slide element respectively and are spaced sufficiently close to one another in the retracted position of the platen to be grasped by an adult hand and squeezed together to advance the platen toward its inserted position while the entire press with the can therein may be held in that one grasping hand for appropriate drainage of liquid expelled from the can contents.

In a preferred form of the invention a pair of parallel standards extended rigidly from the base, and the inner squeezing handle spans ends of the pair of standards remote from the base. A pair of slide elements may be linearly translatable along the respective standards, and the outer squeezing handle may span ends of the pair of slide elements remote from the base. The slide elements may fit telescopically around the respective standards.

A circular seat may be provided on the base between the pair of standards for receiving a cylindrical can and positioning the can in axial opposition to the platen. A plurality of concentric stepped seats may be provided for receiving cylindrical cans of varying diameters.

Preferably the base and standards and the inner handle connecting the standards are of unitary construction, and the slide elements and the outer handle connecting the slide elements are also of unitary construction. The platen may be substantially wedge-shaped to crease the severed can end substantially diametrically as the platen presses the severed can end into the moist contents within the can. The base may include a planar underside permitting the press to stand upright on a horizontal surface. The platen may be removable from the slide elements.

DESCRIPTION OF PREFERRED EMBODIMENT

Figure 1:
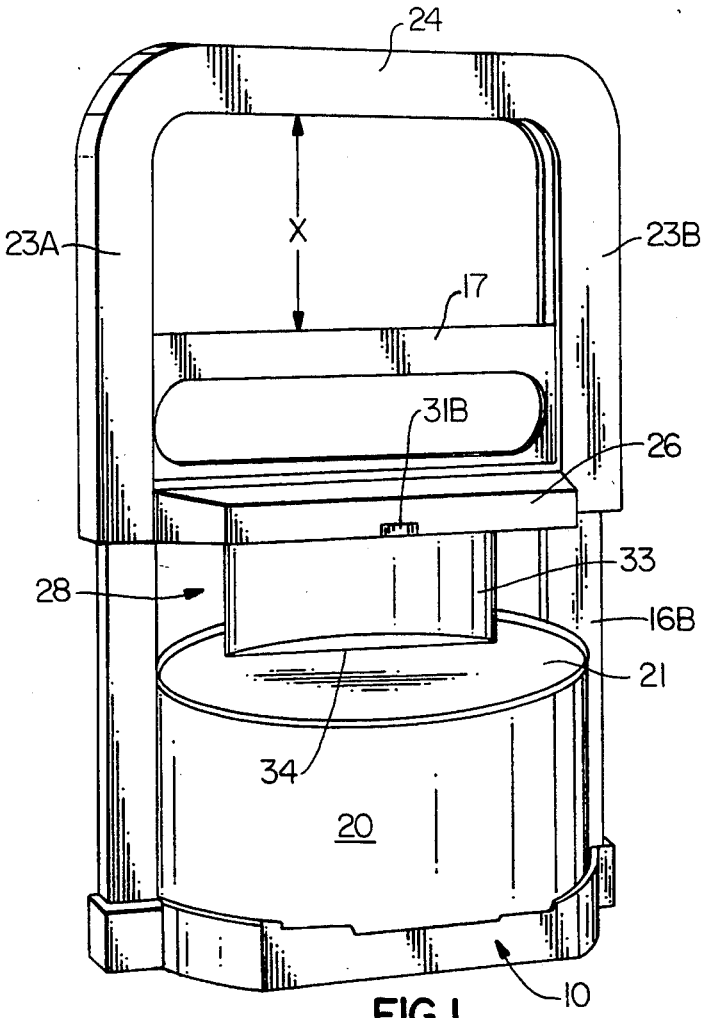
FIG. 1 is a perspective view of the assembled press of the invention with a can in place on the base and the slide element in its retracted position.
Figure 2:
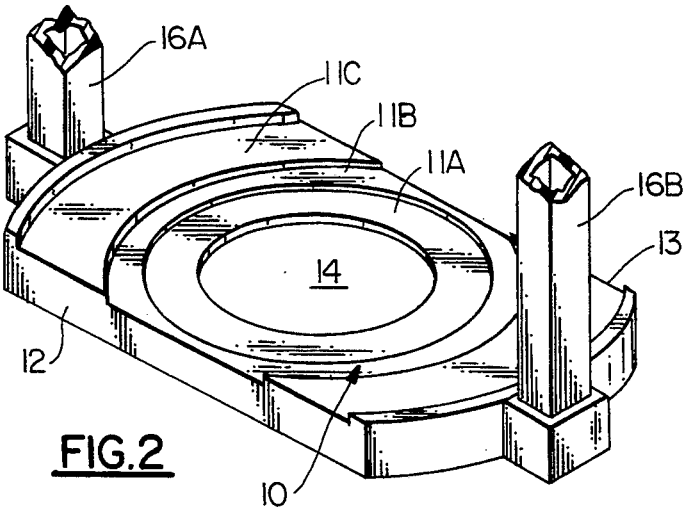
FIG. 2 is a fragmentary perspective view of the base showing the concentric circular stepped seats.

Referring first to FIGS. 1 and 2 the preferred form of the hand-operated can press of the invention includes a base 10 having a planar underside permitting the press to stand upright on a horizontal surface. Three concentric partially circular stepped sets 11A, 11B and 11C are formed on the upper side of the base 10 for receiving cans of varying diameters. For economy of material the base 10 may have flat chordal sides 12 and 13 and a central circular hole 14 coaxial with the seats 11A to C.

A pair of parallel elongated standards 16A and 16B of rectangular cross section extend rigidly and perpendicularly from the base. An inner squeezing handle 17 extends substantially perpendicularly between the ends of the standards 16A and 16B remote from the base 10. The base 10, the standards 16A and 16B and the inner handle 17 may be of plastic and of a one-piece unitary construction.

A typical can 20 may be positioned on the base 10 and as shown in FIG. 1 it occupies the largest diameter partially circular seat 11C. One circular end 21 of the can 20 is severed by any conventional can opener but left in place on the moist contents within the can. In position on the base 10 the can 20 is disposed between the standards 16A and 16B with its axis parallel to those standards.

A pair of slide elements 23A and 23B of U-shaped cross section are telescoped on and therefore are linearly translatable along the respective standards 16A and 16B. An outer squeezing handle 24 extends perpendicularly from the slide elements 23A and 23B. It is preferred that the slide elements 23A and 23B and the outer handle 24 be of the same plastic material as the base 10, standards 16A and 16B and inner handle 17, and also that they be of a one-piece unitary construction. A transverse frame element 26 extends integrally between the ends of the slide elements 23A and 23B remote from the outer handle 24.

Figure 3:
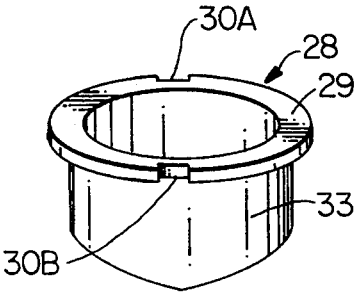
FIG. 3 is a perspective view of the platen removed from the slide element.

Removably attached to the underside of the frame element 26 which is opposed to the base 10 is a substantially cylindrical platen 28 shown particularly in FIG. 3. The platen is a cup-shaped element made of the same plastic as the other parts of the press. It has an upper circular rim 29 formed with diametrically opposed slots 30A and 30B. These slots snap removably onto ears 31 projecting from the underside of the frame element 26, that ear 31 which engages the slot 30B being visible in FIG. 1. The platen 28 includes a ram portion 33 which is substantially cylindrical but has a lower end which is slightly wedge-shaped along a ridge line 34. A magnet may be provided on the surface of the lower end of the ram portion 33 to retain the severed can lid after pressing is completed.

In operation the press is assembled simply by snapping the platen 28 into place on the frame element 26 and sliding the slide elements 23A and 23B downwardly on the standards 16A and 16B as the press stands on its flat underside on a horizontal surface such as a kitchen counter. The end 21 of the can 20 is severed. The outer handle 24 is lifted away from the inner handle 17 to its retracted position marked "X" in FIG. 1, and that dimension is sufficiently small so that an adult can easily grasp the inner handle 17 and the outer handle 24 in one hand. In this retracted position of the platen 28 there is sufficient clearance for the can 20 to be placed on the appropriate partially circular seat on the platen 10. The operator simply squeezes the outer handle 24 with the heel of the hand downwardly toward the inner handle 17 grasped by the fingers, and this moves the platen downwardly so that its lower wedge-shaped face is forced onto the can end 21. As a consequence the can end 21 is forced onto the moist can contents.

As this squeezing action begins the operator may with that one hand extend the entire press and can outwardly over a sink or bowl or other appropriate drainage receiving means. As further squeezing of the hand takes place the platen 28 thrusts the can end 21 further against the contents to squeeze out all liquid as desired. In doing so the wedge-shaped end of the platen causes the can end 21 to be slightly creased diametrically along the ridge line 34 of the platen, thus allowing the squeezed-out liquid to escape from the can 20.

When the pressing operation is complete the press is again positioned upright on a horizontal surface, the outer handle 24 is retracted and the can 20 is removed from the base.

Disassembly for cleaning is done simply by sliding the slide elements 23A and 23B off of the standards 16A and 16B and snapping the platen 28 off of the frame element 26. The entire disassembled press comprising only three parts may then be machine washed.

The scope of the invention is to be taken from the following claims rather than from the foregoing description of preferred embodiment.

I claim:

1. A hand-operated can press for forcing a can end axially into moist can contents against an opposite unsevered can end to expel liquid from said contents comprising a) a base on which the unsevered can end is positionable, b) a pair of parallel standards extending rigidly and substantially perpendicularly from the base to be alongside the positioned can and parallel to the can axis, c) a slide element linearly translatable along the standards, d) a platen mounted on the slide element for linear movement from a retracted position permitting placement of the can on the base to an inserted position engaging and pressing the severed can end into the moist contents within the can, and e) substantially parallel opposed inner and outer squeezing handles extending substantially perpendicularly from the standards and slide element respectively and spaced sufficiently close to one another in the retracted position of the platen to be grasped by an adult hand and squeezed together to advance the platen toward its inserted position while the entire press with the can may be held in that one grasping hand for appropriate drainage of liquid expelled from the can contents, f) the inner squeezing handle spanning ends of the pair of standards remote from the base.

2. A hand press according to claim 1 wherein a pair of slide elements are linearly translatable along the respective standards, and the outer squeezing handle spans ends of the pair of slide elements remote from the base.

3. A hand press according to claim 2 wherein the slide elements fit telescopically around the respective standards.

4. A hand press according to claim 2 wherein the slide elements and the outer handle connecting the slide elements are of unitary construction.

5. A hand press according to claim 1 wherein an at least partially circular seat is provided on the base between the pair of standards for receiving a cylindrical can and positioning the can in axial opposition to the platen.

6. A hand press according to claim 5 wherein a plurality of concentric stepped seats are provided for receiving cylindrical cans of varying diameters.

7. A hand press according to claim 1 wherein the base and standards and the inner handle connecting the standards are of unitary construction.

8. A hand press according to claim 1 wherein the platen is substantially wedge-shaped to crease the severed can end substantially diametrically as the platen presses the severed can end into the moist contents within the can.

9. A hand press according to claim 1 wherein the base includes a planar underside permitting the press to stand upright on a horizontal surface.

10. A hand-operated can press for forcing a cylindrical can end axially into moist can contents against an opposite unsevered cylindrical can end to expel liquid from said contents comprising a) a base having a planar underside permitting the press to stand upright on a horizontal surface, b) a pair of parallel elongated standards extending rigidly and substantially perpendicularly from the base, c) a plurality of concentric partially circular stepped seats on the base between the pair of standards for receiving the cans of varying diameter and positioning the can between with its axis parallel to the standards, d) a pair of slide elements telescoped on and linearly translatable along the respective standards, e) a wedge-shaped platen mounted on the slide element for linear movement along the axis of the positioned can from a retracted position permitting placement of the can on the base to an inserted position engaging and pressing the severed can end into the moist contents within the can and diametrically creasing the severed can end, f) substantially parallel opposed inner and outer squeezing handles extending substantially perpendicularly from the standards and slide elements respectively and spaced sufficiently close to one another in the retracted position of the platen to be grasped by an adult hand and squeezed together to advance the platen toward its inserted position while the entire press with the can therein may be held in that one grasping hand for appropriate drainage of liquid expelled from the can contents, g) the base and standards and the inner handle connecting the standards being of unitary construction, h) the slide elements and the outer handle connecting the slide elements being of unitary construction, and i) the platen being removable from the slide elements.

* * * * *